US011532223B1

(12) United States Patent
Jeon et al.

(10) Patent No.: US 11,532,223 B1
(45) Date of Patent: Dec. 20, 2022

(54) VULNERABLE SOCIAL GROUP DANGER RECOGNITION DETECTION METHOD BASED ON MULTIPLE SENSING

(71) Applicant: Cheil Electric Wiring Devices Co., Ltd., Busan (KR)

(72) Inventors: Byung Kwon Jeon, Busan (KR); Byeong Hoon Lee, Gimhae-si (KR)

(73) Assignee: Cheil Electric Wiring Devices Co., Ltd., Busan (KR)

( * ) Notice: Subject to any disclaimer, the term of this patent is extended or adjusted under 35 U.S.C. 154(b) by 0 days.

(21) Appl. No.: 17/581,861

(22) Filed: Jan. 22, 2022

(51) Int. Cl.
*G08B 21/04* (2006.01)

(52) U.S. Cl.
CPC ..... *G08B 21/0423* (2013.01); *G08B 21/043* (2013.01); *G08B 21/0438* (2013.01)

(58) Field of Classification Search
CPC ..... G08B 21/0423
See application file for complete search history.

(56) References Cited

U.S. PATENT DOCUMENTS 6,696,956 B1 * 2/2004 Uchida ..... G08B 21/0492 379/49
7,042,338 B1 * 5/2006 Weber ..... G08B 21/0288 340/309.5
10,037,668 B1 * 7/2018 DesGarennes ..... G08B 21/0415
10,140,837 B2 * 11/2018 Shen ..... A61B 5/447
2017/0262697 A1 * 9/2017 Kaps ..... G11B 27/022
2018/0330602 A1 * 11/2018 Kleihorst ..... G08B 25/014
2019/0043622 A1 * 2/2019 Ramaci ..... G06F 1/163
2021/0375121 A1 * 12/2021 Bauer ..... G06F 1/3265
2022/0172593 A1 * 6/2022 Deutsch ..... G08B 21/02

FOREIGN PATENT DOCUMENTS

KR 102167296 B1 10/2020
WO 2011055255 A1 5/2011

* cited by examiner

*Primary Examiner* — Travis R Hunnings
(74) *Attorney, Agent, or Firm* — Broadview IP Law, PC

(57) ABSTRACT

The present invention relates to a multi-sensing-based vulnerable social group danger recognition detection method of sensing a person being monitored and residence states in real time in a vulnerable social group residence, and, if an analysis result based on the sensed information corresponds to a dangerous situation, transmitting information thereabout to a guardian or related organizations so as to quickly respond thereto. In addition, the present invention is configured to include operations S100 to S800 of receiving sensing information from a sensing means (100) comprised of one or more sensors, analyzing the sensing information, and transmitting, to a central server (300), a dangerous-situation analysis information result of a person being monitored and an alarm signal according thereto.

5 Claims, 12 Drawing Sheets

FIG. 12

| | HEART RATE | OPENING/ CLOSING OF DOOR | POWER CONSUMPTION | VERTICAL | HORIZONTAL | SPEED | BODY TEMPERATURE |
|---|---|---|---|---|---|---|---|
| HEART RATE | | O | O | O | O | O | O |
| OPENING/ CLOSING OF DOOR | O | | O | X | O | X | X |
| POWER CONSUMPTION | O | O | | X | O | X | X |
| VERTICAL | O | X | X | | X | O | X |
| HORIZONTAL | O | O | O | X | | X | X |
| SPEED | O | X | X | O | X | | X |
| BODY TEMPERATURE | O | X | X | X | X | X | |

VULNERABLE SOCIAL GROUP DANGER RECOGNITION DETECTION METHOD BASED ON MULTIPLE SENSING

CROSS-REFERENCE TO RELATED APPLICATION(S)

This application is based on and claims priority under 35 U.S.C. 119 to Korean Patent Application No. 10-2022-0004479, filed on Jan. 12, 2022, in the Korean Intellectual Property Office, the disclosure of which is herein incorporated by reference in its entirety.

BACKGROUND OF THE INVENTION

1. Field of the Invention

The present invention relates to a multi-sensing-based vulnerable social group danger recognition detection method of sensing a person being monitored and residence states in real time in a vulnerable social group residence, and, if an analysis result based on the sensed information corresponds to a dangerous situation, transmitting information thereabout to a guardian or related organizations so as to quickly respond thereto.

2. Description of the Prior Art

Recently, the number of elderly people living alone has increased due to the nuclear family, low fertility, and aging population. Since there is a limit to the method of recognizing a dangerous situation or physical abnormality occurring in the elderly living alone, the government and welfare-related organizations need to construct a social safety net for the welfare of the elderly and vulnerable social groups.

In the prior art, in order to sense the state of a vulnerable social group in real time, an IoT-based system including various sensors is installed and operated at a remote location.

The system determines that the situation is dangerous if one or more of the values sensed through respective sensors are determined to be abnormal information.

In this case, the abnormal information may include an act of sitting on a seat, an act of lying on the bed, a fall of an outsider, etc., but the system is unable to distinguish them and may analyze invalid garbage information to determine the situation.

In this case, much information is input from various sensors, and since the system analyzes all the information, processing speed thereof is slowed down, and the reliability of the analysis result is lowered.

Further, when analysis is performed on the basis of a single sensor value, the system is unable to distinguish an act of lying on the bed from a fall, which may cause unnecessary reactions.

In addition, since the system is unable to specifically recognize dangerous situations such as fainting and trauma due to a fall, it is difficult to respond to the situation with an accurate determination.

SUMMARY OF THE INVENTION

In order to solve the above problem, an objective of the present invention is provide a multi-sensing-based vulnerable social group danger recognition detection method of receiving multiple pieces of sensing information from sensors provided in a residence, when abnormal information is sensed by any one of the sensors, generating an event to recognize a dangerous situation, and analyzing multiple pieces of sensing information at the time corresponding to the event generation time, thereby more accurately determining a dangerous situation.

Another objective of the present invention is to provide a multi-sensing-based vulnerable social group danger recognition detection method of detecting garbage information that is not valid for analysis from among sensing information input through multiple sensing and applying only valid sensing information to an artificial neural network, thereby improving the reliability of analysis results and processing speed.

A vulnerable social group danger recognition detection method based on multiple sensing according to the embodiment of the present invention includes: an operation S100 of sensing biometric information, actions, and residence states of a person being monitored by a sensing means comprised of one or more sensors; an operation S200 of inputting sensing information in which biometric information, action information, and residence state information of the person being monitored are combined from the sensing means to an information input module; an operation S300 of transmitting the sensing information combined by the information input module to an information storage module and a validity determination module; an operation S400 of determining the validity of the sensing information by the validity determination module; an operation S500 of separating sensing information corresponding to invalid information among the sensing information stored in the information storage module into garbage information, and deleting the garbage information after a predetermined period of time elapses; an operation S600 of transmitting the sensing information corresponding to valid information in the information storage module to an information analysis module; an operation S700 of dividing the sensing information into biometric information, action information, and residence state information of the person being monitored, respectively, by the information analysis module using an artificial neural network, and combining abnormal information among the divided information to analyze a dangerous situation of the person being monitored; and an operation S800 of outputting a dangerous-situation analysis result derived through the information analysis module and an alarm signal according thereto by a result output module.

The operation S100 includes an operation S110 of sensing biometric information of the person being monitored through a biometric information collection module, an operation S120 of sensing actions of the person being monitored through an action sensing module, an operation S130 of sensing whether a door is opened or closed in a residence through a door sensing module, and an operation S140 of sensing power consumption in the residence through a power sensing module In the operation S200, the sensing information input from the sensing means is grouped for each predetermined time range by the information input module.

In the operation S400, a plurality of sensing values constituting the sensing information are individually analyzed by the validity determination module, and if any one thereof is determined to be abnormal information, sensing time information of corresponding sensing information is transmitted to the information storage module.

In addition, in the operation S400, the validity of the sensing information is preferentially determined on the basis of the biometric information among the biometric information, the action information, and the residence state information of the person being monitored by the validity determination module.

In the operation S600, the sensing information corresponding to the sensing time information received from the validity determination module is transmitted to the information analysis module by the information storage module.

In the case of a general vertical sensor, it is not easy to distinguish the situation in which a person being monitored is simply lying on the bed or floor from the situation in which the person being monitored has fallen down to the floor, so an alarm may go off even when a dangerous situation does not actually occur.

However, in the vulnerable social group danger recognition detection method based on multiple sensing according to the embodiment of the present invention, if an abnormal situation is recognized in any one piece of sensing information sensed through multiple sensing, it may be analyzed by being combined with sensing values of associated sensing information, thereby more accurately analyzing a danger situation.

That is, according to the present invention, an alarm can be more accurately triggered, thereby reducing errors in crisis response situations such as emergency dispatch and reducing unnecessary responses thereto, or enabling a rapid response according to accurate determination of the situation.

In addition, it is possible to improve the reliability of analysis results and a processing speed thereof by detecting garbage information, which is not valid for analysis, from among sensing information sensed through multiple sensing using a validity determination module and applying only sensing information, which is valid for analysis, to the artificial neural network.

Furthermore, various effects directly or indirectly identified will be provided through the present specification.

BRIEF DESCRIPTION OF THE DRAWINGS

The above and other aspects, features, and advantages of the present disclosure will be more apparent from the following detailed description taken in conjunction with the accompanying drawings, in which:

FIG. 12 is a diagram illustrating the case in which respective pieces of sensing information can be combined according to the embodiment of the present invention.

DETAILED DESCRIPTION OF THE EXEMPLARY EMBODIMENTS

Figure 1:
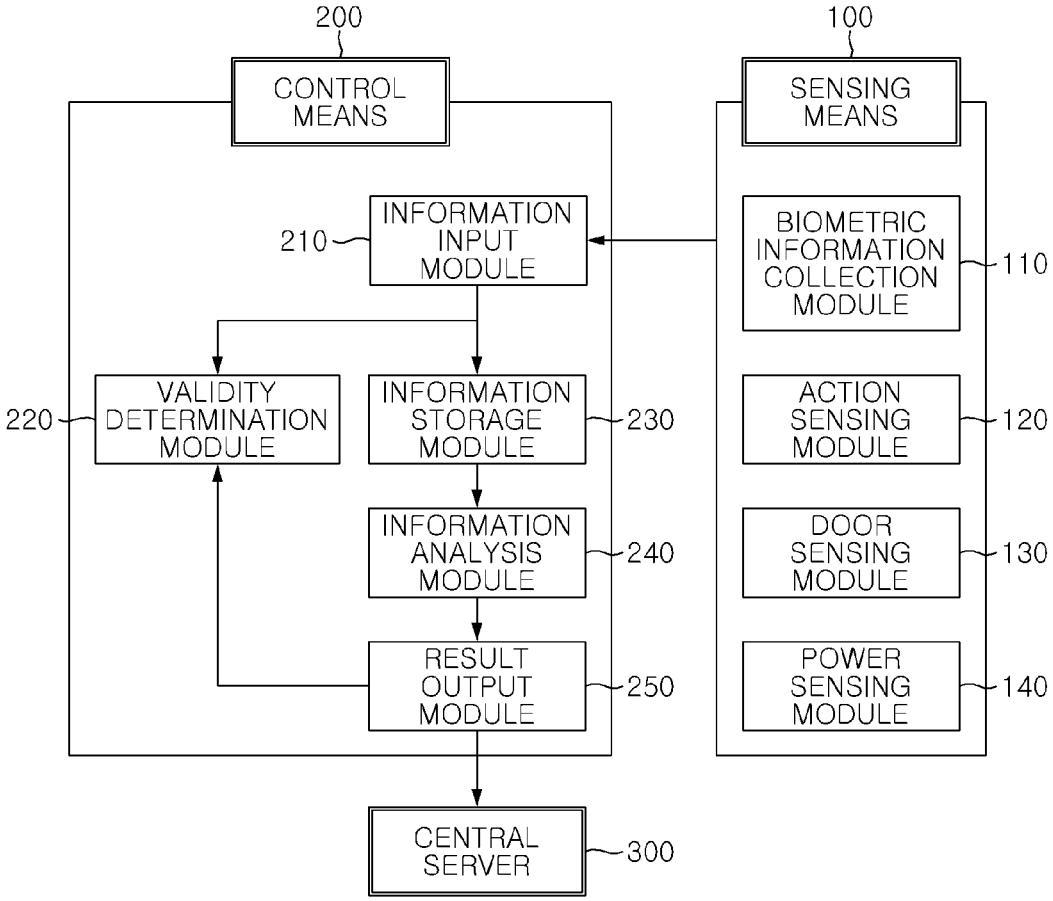
FIG. 1 is a block diagram illustrating the configuration of a vulnerable social group danger recognition detection system using multiple sensors according to the embodiment of the present invention.

Hereinafter, some embodiments of the present invention will be described in detail with reference to exemplary drawings.

In adding reference numerals to elements in each drawing, the same elements will be denoted by the same reference numerals even though they are shown in different drawings.

Figure 2:
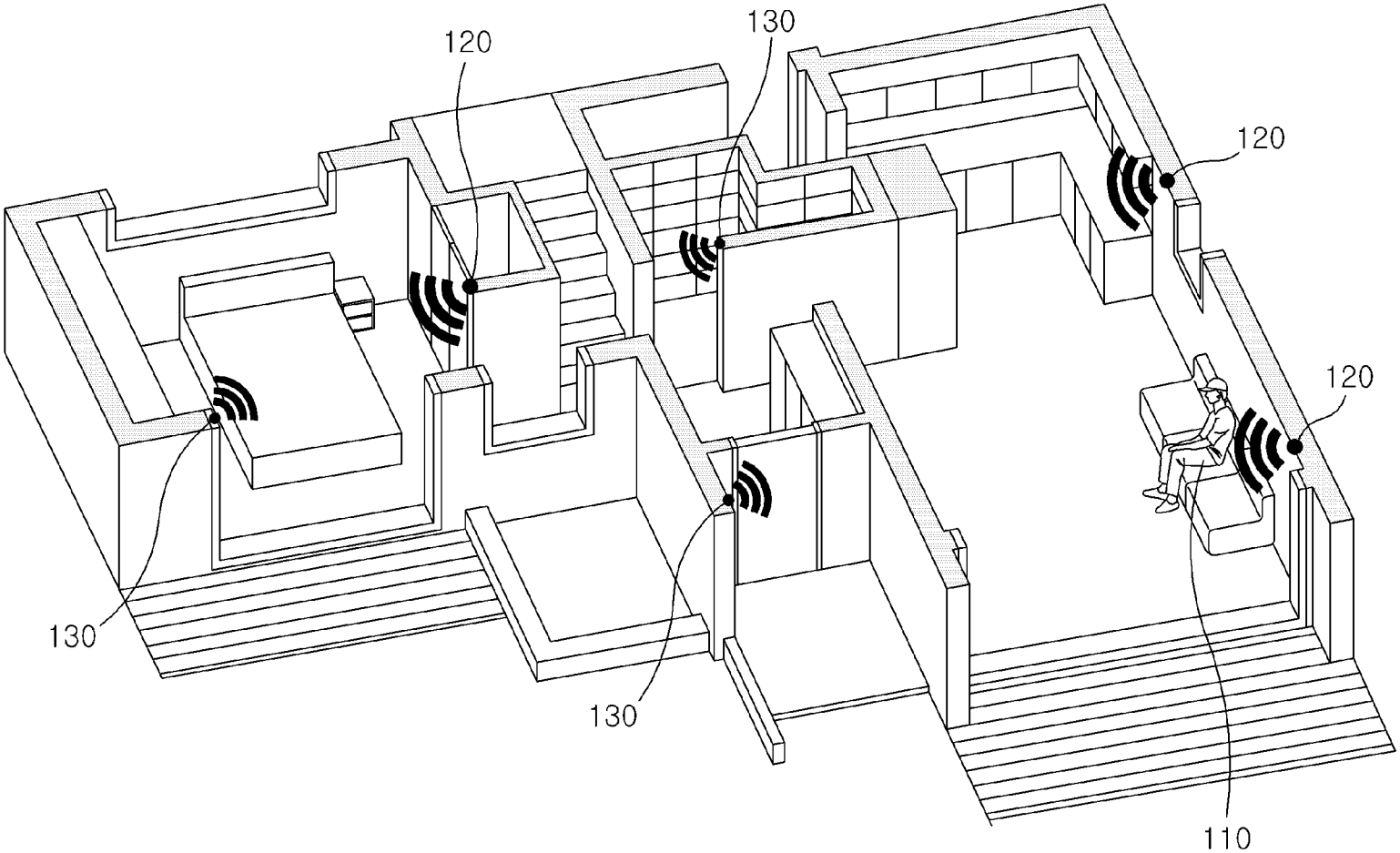
FIG. 2 is a diagram illustrating a state in which sensing means is installed in the residence of a person being monitored to sense the person being monitored according to the embodiment of the present invention.

FIG. 1 is a block diagram illustrating the configuration of a vulnerable social group danger recognition detection system using multiple sensors according to the embodiment of the present invention, and FIG. 2 is a diagram illustrating a state in which sensing means is installed in the residence of a person being monitored to sense the person being monitored according to the embodiment of the present invention.

Referring to these drawings, a vulnerable social group danger recognition detection system using multiple sensors according to the embodiment of the present invention includes a sensing means 100, a control means 200, and a central server 300.

The sensing means 100 senses biometric information, actions, and residence states of a person being monitored. The sensing means 100 includes a biometric information collection module 110, an action sensing module 120, a door sensing module 130, and a power sensing module 140.

In addition, the sensing means 100 may include one or more of a fire sensing module, a temperature sensing module, a humidity sensing module, an illuminance sensing module, a smoke sensing module, or a gas leak sensing module, which is installed on one side of the residence to sense the states thereof.

In addition, the sensing means 100 may produce sensing information that is associated with metadata including time information and location information.

The time information may include sensing time information and day information, and the location information may include residence ID information, module ID information, and the like.

The biometric information collection module 110 may be attached to the body of the person being monitored to collect biometric information of the person being monitored, and may sense at least one of a heart rate, an electrocardiogram, a blood pressure, a body temperature, and an EEG of the person being monitored.

The biometric information collection module 110 may be configured as a wearable device, and the device may be equipped with a notification release button.

When the person being monitored is in a dangerous situation, information about the dangerous situation and an alarm signal may be transmitted by the control means 200 to the central server 300, but in the case where help is unnecessary due to an outsider's response to the situation in the residence, information thereabout may be transmitted to the central server 300 through the notification release button.

The action sensing module 120 includes a vertical sensing part for sensing the movement of the person being monitored in the vertical direction and a horizontal sensing part for sensing the movement thereof in the left-right direction, which are installed on one side of the residence of the person being monitored.

Each of the vertical sensing part and the horizontal sensing part may be configured as two pyroelectric infrared sensors.

In this case, the two vertical sensing parts are positioned to be spaced a predetermined distance apart from each other in the vertical direction, and the horizontal sensing parts are positioned to be spaced the predetermined distance apart from each other in the left-right direction.

In addition, it is possible to sense the vertical and left-right movement directions, speed, and body temperature of the person being monitored, and the distance between the person being monitored and the action sensing module 120 through a waveform generated by the action sensing module 120.

The door sensing module 130 senses opening and closing of a door installed in the residence.

The power sensing module 140 senses power consumption of the residence.

The control means 200 includes an information input module 210, a validity determination module 220, an information storage module 230, an information analysis module 240 and a result output module 250.

The information input module 210 receives, from the sensing means 100, sensing information in which biometric information, action information, and residence state information of the person being monitored are combined. Then, the information input module 210 groups and stores the sensing information for each predetermined time range, and transmits the same to the validity determination module 220 and the information storage module 230.

The time range is 1 minute, and may be set on the basis of information on a heart rate per minute of the person being monitored, which is sensed by the biometric information collection module 110.

The validity determination module 220 determines the validity of the received sensing information, and, if one or more pieces of the biometric information, the action information, and the residence state information of the person being monitored is determined to be abnormal information, determines the corresponding sensing information to be valid sensing information for analysis. Specifically, the validity determination module 220 individually analyzes the sensing information in which a heart rate, a body temperature, a vertical movement direction, a left-right movement direction, a movement speed, and a position of the person being monitored, opening or closing of a door, and power consumption are combined, which is received from the information input module 210, thereby determining the validity of the corresponding sensing information.

In this case, the validity determination module 220 may preferentially determine the validity of the sensing information on the basis of information on the heart rate per minute of the person being monitored, which is sensed by the biometric information collection module 110.

If the received sensing information is determined to be valid information for analysis, the validity determination module 220 generates an event for recognizing a dangerous situation. Then, event generation time information, which is sensing time information of the corresponding sensing information, is transmitted to the information storage module 230.

The information storage module 230 stores all sensing information received from the information input module 210, and separates sensing information that does not correspond to the event generation time information received from the validity determination module 220 into garbage information.

In addition, if a predetermined period of time elapses, the garbage information is deleted, and the period of time may be set to 8 hours, which are appropriate sleeping hours for the person being monitored.

In addition, the information storage module 230 transmits sensing information corresponding to the event generation time information received from the validity determination module 220 to the information analysis module 240.

The information analysis module 240 respectively divides the sensing information into biometric information, action information, or residence state information of the person being monitored by applying an artificial neural network to the sensing information received from the information storage module 230.

Specifically, the sensing information may be divided into a heart rate, a vertical movement direction, a left-right movement direction, a movement speed, a body temperature, and a position of the person being monitored, opening/closing of a door, and power consumption, which are sensed by the sensing means 100.

In addition, the information analysis module 240 combines sensing information that is determined to be abnormal information, among the divided sensing information, to analyze a dangerous situation of the person being monitored.

In this case, the information analysis module 240 may combine a plurality of pieces of sensing information having a predetermined time range into one piece of sensing information.

For example, a plurality of pieces of sensing information grouped every 1 minute by the information input module 210 may be continuously combined to produce one piece of sensing information having a range of 1 hour. In this case, the information analysis module 240 may receive garbage information from the information storage module 230 to continuously combine the sensing information.

The result output module 250 transmits, to the central server 300, dangerous-situation analysis result information of the person being monitored, which is derived through the information analysis module 240, and an alarm signal according thereto.

In addition, valid sensing information according to the analysis result information is transmitted to the validity determination module 240 so as to be used as learning information for determination of validity.

The central server 300 may be a server or a client that is installed in a guardian, a related organization, or the like so as to receive result information and an alarm signal from the control means 200.

Figure 3:
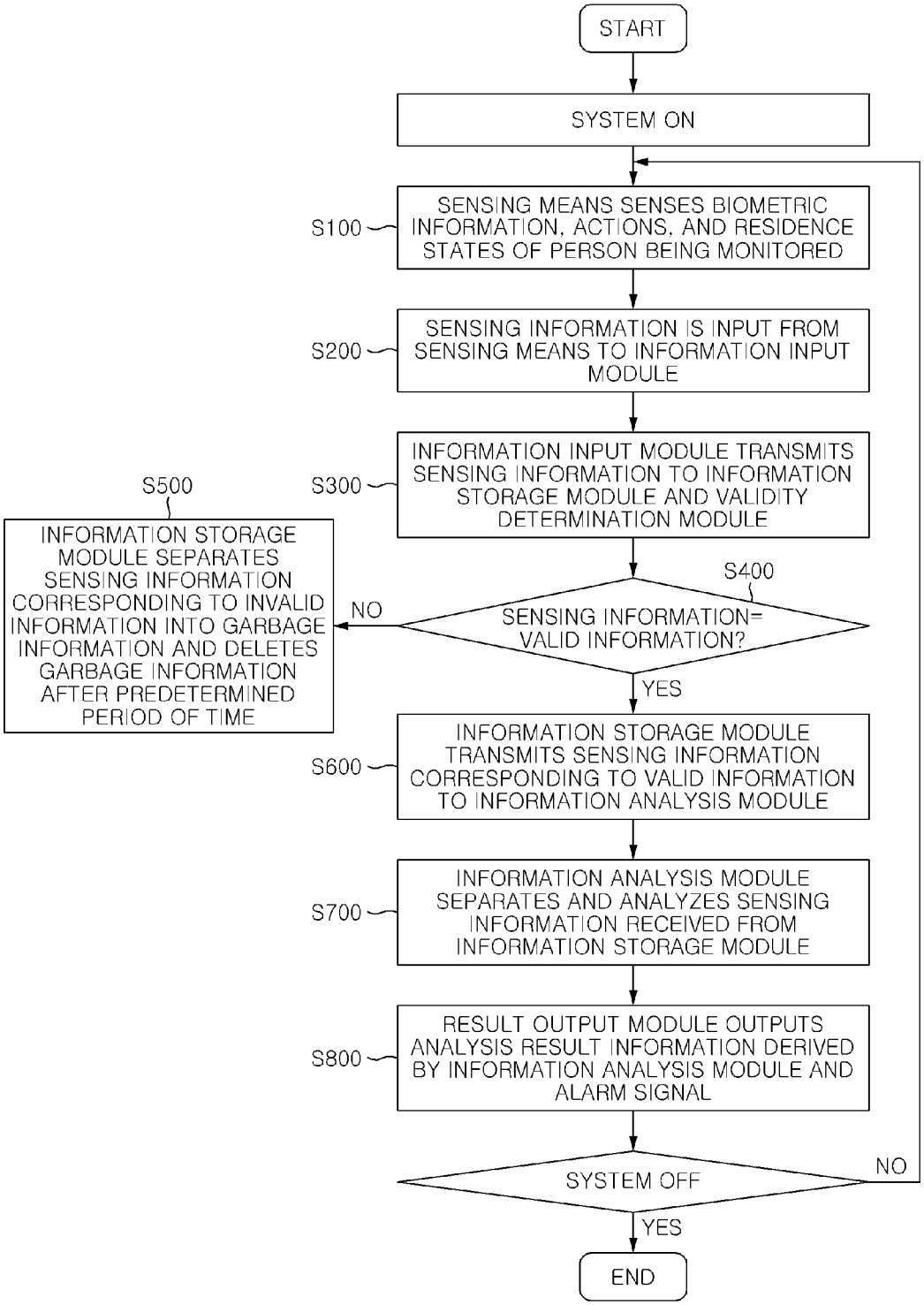
FIG. 3 is a flowchart illustrating a vulnerable social group danger recognition detection method based on multiple sensing according to the embodiment of the present invention.

FIG. 3 is a flowchart illustrating a vulnerable social group danger recognition detection method based on multiple sensing using multiple sensors according to the embodiment of the present invention.

Referring to FIG. 3, the method is configured to include operations S100 to S800 of receiving sensing information from the sensing means 100 comprised of one or more sensors, analyzing the sensing information, and transmitting, to the central server 300, a dangerous-situation analysis information result of a person being monitored and an alarm signal according thereto.

Operation S100 includes operations S110 to S140 for sensing biometric information, actions, and residence states of the person being monitored.

In operation S110, biometric information of the person being monitored is sensed by the biometric information collection module 110.

In operation S120, actions of the person being monitored are sensed by the action sensing module 120.

In operation S130, whether a door is opened or closed in the residence is sensed by the door sensing module 130.

In operation S140, power consumption in the residence is sensed by the power sensing module 140.

In operation S200, sensing information in which biometric information, action information, and residence state information of the person being monitored are combined by the sensing means 100 is input to the information input module 210, and the sensing information is grouped for each predetermined time range by the information input module 210.

In operation S300, the sensing information grouped by the information input module 210 is transmitted to the validity determination module 220 and the information storage module 230.

In operation S400, a plurality of sensing values constituting the sensing information is individually analyzed by the validity determination module 220, and if any one thereof is determined to be abnormal information, sensing time information of corresponding sensing information is transmitted to the information storage module 230.

In this case, the validity of the sensing information may be preferentially determined by the validity determination module 220 on the basis of the biometric information among the biometric information, the action information, and the residence state information of the person being monitored.

Figure 4:
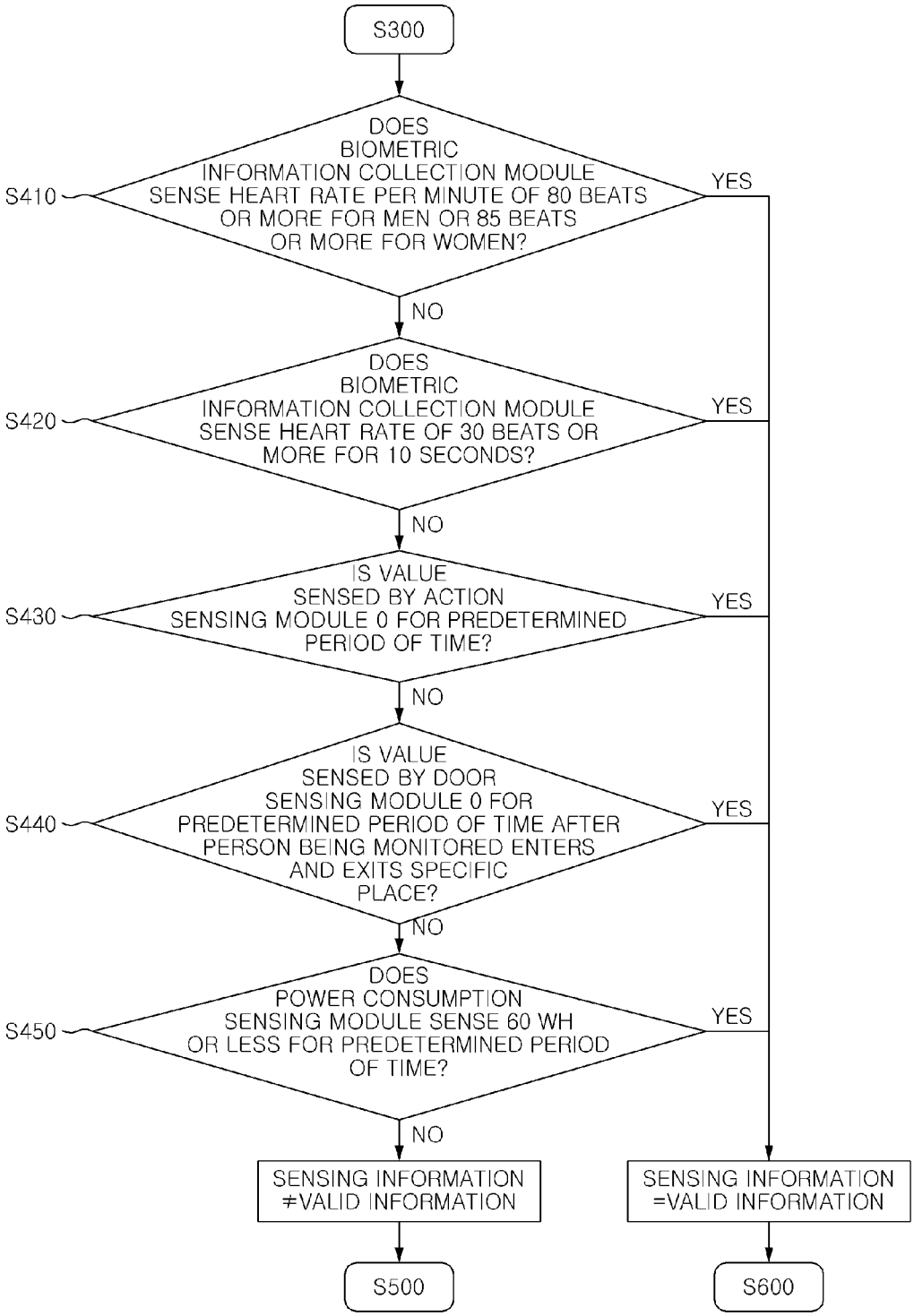
FIG. 4 is a flowchart illustrating a method for determining the validity of sensing information according to the embodiment of the present invention.

FIG. 4 is a flowchart illustrating a method for determining the validity of sensing information according to the embodiment of the present invention. Referring to FIG. 4, operation S400 includes operations S410 to S450 for determining the validity of sensing information.

In operation S410, it is analyzed whether the heart rate per minute falls outside of a normal range depending on the sex and age of the person being monitored, and if the heart rate per minute is not normal, the sensing information is determined to be valid information.

Operation S420 may be performed if the heart rate per minute of the person being monitored is normal in operation S410.

In operation S420, it is analyzed whether an abnormal pattern appears in the heart rate of the person being monitored for 1 minute, and if the abnormal pattern appears, corresponding sensing information is determined to be valid information. The abnormal pattern may indicate a heart rate of 30 beats or more for 10 seconds.

If the abnormal pattern does not appear in operation S420, operations S430 to S450 may be performed.

In this case, the sequence of operations S430 to S450 may be varied.

In operation S430, it is analyzed whether there is a section where a movement speed value of the person being monitored is "0" for a predetermined period of time, and if there is a section where the movement speed value is "0", it is determined to be abnormal information, so corresponding sensing information is determined to be valid information.

In operation S440, it is analyzed whether there is a section where a value indicating opening/closing of a door is "0" for a predetermined period of time after the person being monitored enters and exits a specific place, and if there is a section where the value is "0", it is determined to be abnormal, so corresponding sensing information is determined to be valid information.

In operation S450, it is analyzed whether power consumption of the residence does not change for a predetermined period of time or whether there is a section where the power consumption is less than or equal to predetermined power consumption, and if the power consumption does not change or is less than or equal to 60 Wh, it is determined to be abnormal, so corresponding sensing information is determined to be valid information.

In operation S500, sensing information corresponding to invalid information among the sensing information stored in the information storage module 230 is separated into garbage information, and the garbage information is deleted after a predetermined period of time elapses.

In operation S600, sensing information corresponding to valid information is transmitted from the information storage module 230 to the information analysis module 240.

In operation S700, the sensing information is divided into biometric information, action information, and residence state information of the person being monitored using an artificial neural network in the information analysis module 240, and abnormal information among the divided information is combined to analyze a dangerous situation of the person being monitored.

In operation S800, the dangerous-situation analysis result derived through the information analysis module 240 and an alarm signal according thereto are output by the result output module 250.

Figure 5:
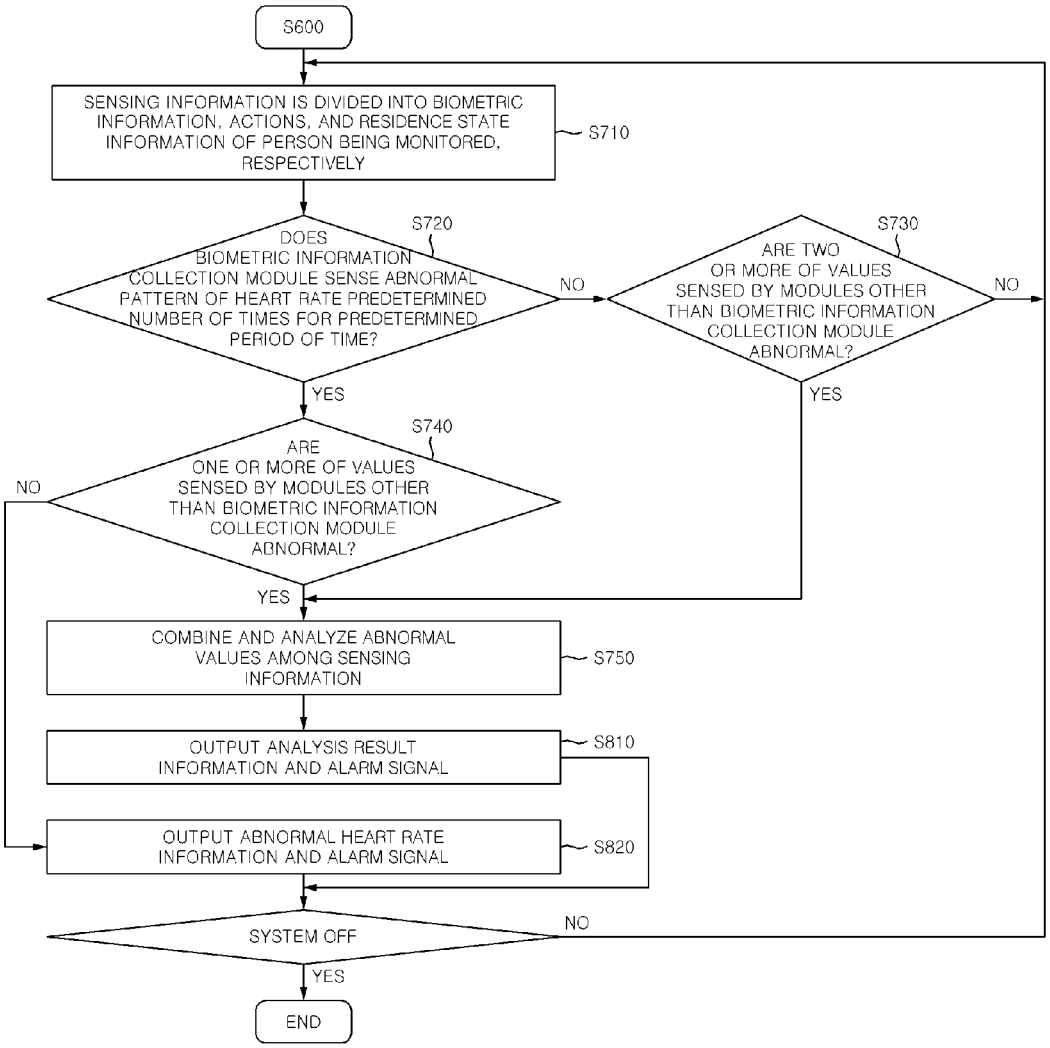
FIG. 5 is a flowchart illustrating a method of distinguishing and analyzing monitoring information and outputting a result thereof according to the embodiment of the present invention.

FIG. 5 is a flowchart illustrating a method of distinguishing and analyzing monitoring information and outputting a result thereof according to the embodiment of the present invention.

Referring to FIG. 5, operation S700 includes operations S710 to S750 for distinguishing and classifying the monitoring information.

In operation S710, the sensing information received from the information storage module 230 is divided into biometric information, actions, and residence state information of the person being monitored, respectively, by the information analysis module 240.

In operation S720, it is analyzed whether an abnormal pattern of a heart rate per minute of the person being monitored, which is sensed by the biometric information collection module 110, is sensed a predetermined number of times or more for a predetermined period of time.

Operation S730 may be performed if the abnormal pattern is not sensed a predetermined number of times or more in operation S720.

In operation S730, it is analyzed whether two or more of the values sensed by the action sensing module 120, the door sensing module 130, and the power sensing module 140 are abnormal information.

Operation S740 may be performed when the abnormal pattern is sensed a predetermined number of times or more in operation S720.

In operation S740, it is analyzed whether one or more of the values sensed by the action sensing module 120, the door sensing module 130, and the power sensing module 140 are abnormal information.

In operation S750, two or more values of abnormal information, among the sensed values, are combined and analyzed.

The values sensed in operations S730 and S740 indicate a movement direction, movement speed, position, and body temperature of the person being monitored, opening/closing of a door, and power consumption.

Operation S800 includes operations S810 and S820 that are differently performed depending on the analysis result in operation S700.

Operation S810 may be performed when two or more abnormal information values are combined and analyzed in operation S750.

In operation S810, the analysis result information derived in operation S750 and an alarm signal according thereto are transmitted to the central server 300.

Operation S820 is performed if one or more of the values sensed by the action sensing module 120, the door sensing module 130, and the power sensing module 140 are not determined to be abnormal information in operation S740.

In operation S820, information on a heart rate of the person being monitored and an alarm signal according thereto are transmitted to the central server 300.

The information on the heart rate may indicate the case where the heart rate per minute falls outside of a normal range or the case where an abnormal pattern is sensed a predetermined number of times or more for a predetermined period of time.

For example, if an abnormal pattern is sensed 10 times for 10 minutes, the person being monitored may be determined to be in a dangerous situation.

Figure 6:
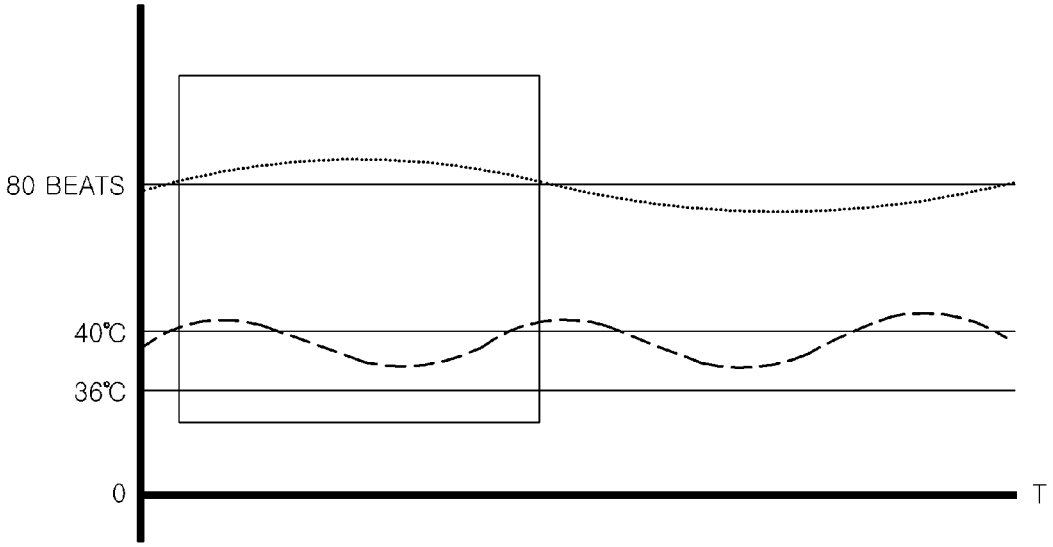
FIG. 6 is a graph illustrating information on a heart rate per minute and a body temperature of a person being monitored according to the embodiment of the present invention.

FIG. 6 is a graph illustrating information on a heart rate per minute (dotted line) and a body temperature (dashed line) of a person being monitored according to the embodiment of the present invention.

Referring to FIG. 6, information on the heart rate per minute and body temperature information of a person being monitored, which are regarded as abnormal for a predetermined period of time among the divided sensing information, are combined by the information analysis module 240.

The heart rate of the person being monitored is sensed as 80 beats per minute or more, which may be regarded as a tachycardia state, and the body temperature thereof is sensed as 40 degrees C. or higher, which may be regarded as a high temperature. Accordingly, it may be determined to be a dangerous situation by the information analysis module 240.

Figure 7:
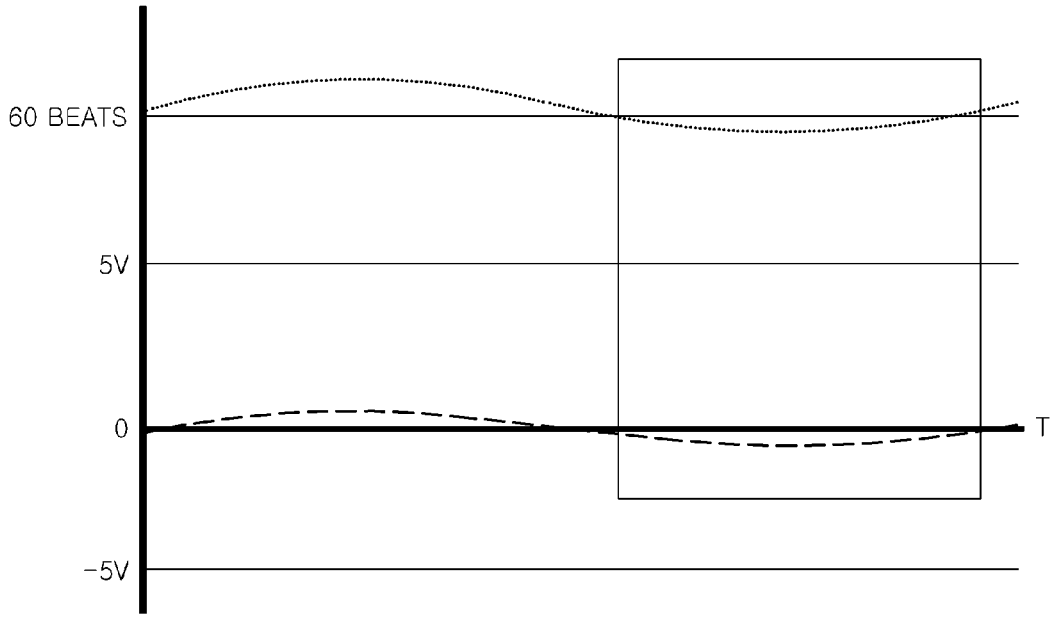
FIG. 7 is a graph illustrating information on a heart rate per minute and a movement speed of a person being monitored according to the embodiment of the present invention.

FIG. 7 is a graph illustrating information on a heart rate per minute (dotted line) and a movement speed (dashed line) of a person being monitored according to the embodiment of the present invention.

Referring to FIG. 7, information on a heart rate per minute, which is regarded as abnormal for a predetermined period of time among the divided sensing information, and movement speed information among the information capable of being combined therewith are combined by the information analysis module 240.

In this case, considering only the movement speed information, it may be determined that the person being monitored is simply slow.

However, since the movement of the person being monitored is sensed to be significantly slow for a predetermined period of time and since the heart rate of the person being monitored is also sensed less than 60 beats per minute, the movement speed of the person being monitored may also be determined to be abnormal information.

In this case, the person being monitored seems to be in a bradycardia state, and the movement also seems to be remarkably slow, so the person being monitored may be determined to be in a dangerous situation by the information analysis module 240.

In addition, even when no movement is sensed at all, the person being monitored may be determined to be in a dangerous situation by the information analysis module 240.

Figure 8:
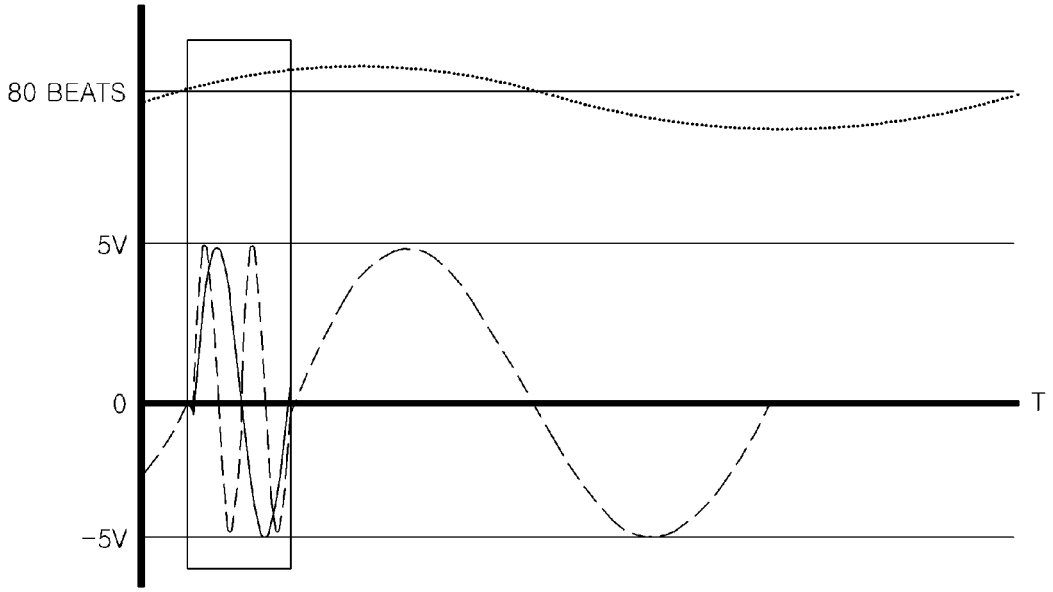
FIG. 8 is a graph illustrating information on a heart rate per minute, a movement speed, and a vertical movement direction of a person being monitored according to the embodiment of the present invention.

FIG. 8 is a graph illustrating information on a heart rate per minute (dotted line), a movement speed (dashed line), and a vertical movement direction (solid line) of a person being monitored according to the embodiment of the present invention.

Referring to FIG. 8, information on a heart rate per minute of a person being monitored, which is regarded as abnormal for a predetermined period of time among the divided sensing information, and movement speed and direction information among the information capable of being combined therewith are combined by the information analysis module 240.

In this case, since the person being monitored seems to move down rapidly and since the heart rate per minute seems to be momentarily increased, it may be determined to be a fall by the information analysis module 240.

In addition, if the movement speed of the person being monitored is sensed to be significantly slow for a predetermined period of time and if the heart rate per minute is continuously sensed as falling outside of a normal range after the determination of a fall, the person being monitored may be determined to be in a dangerous situation by the information analysis module 240.

Figure 9:
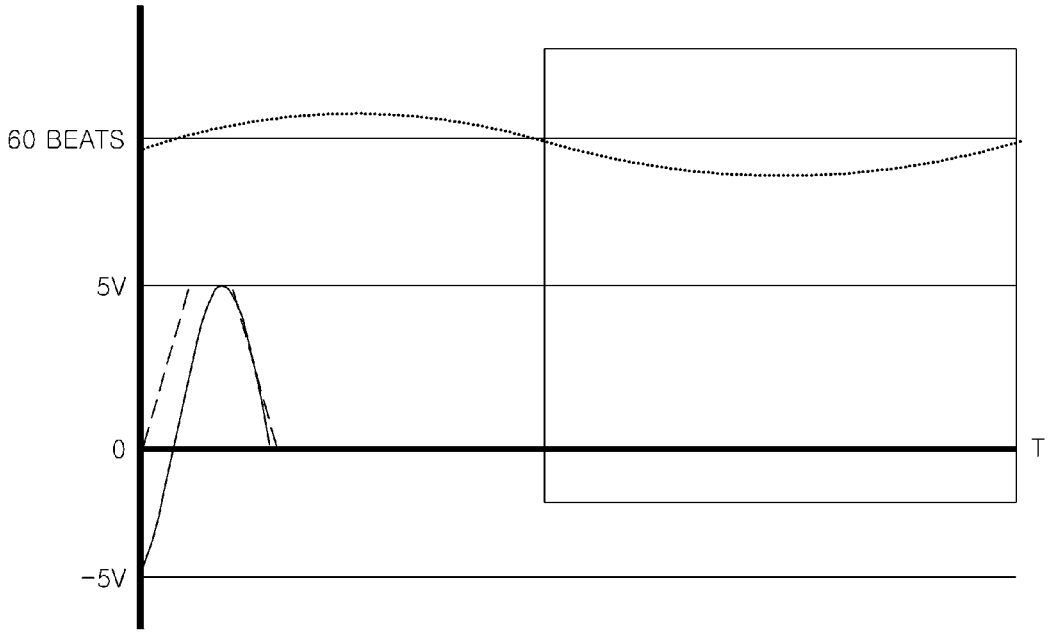
FIG. 9 is a graph illustrating information on a heart rate per minute and a left-right movement direction of a person being monitored, and door opening/closing information according to the embodiment of the present invention.

FIG. 9 is a graph illustrating information on a heart rate per minute (dotted line) and a left-right movement direction information (solid line) of a person being monitored, and door opening/closing information (dashed line) according to the embodiment of the present invention.

Referring to FIG. 9, information on a heart rate per minute of a person being monitored, which is regarded as abnormal for a predetermined period of time among the divided sensing information, door opening/closing formation, and left-right movement direction information among the information capable of being combined therewith are combined by the information analysis module 240.

In this case, it is sensed that the door is not opened again for a predetermined period of time after the person being monitored enters and exits a specific place such as a bathroom, a veranda, or the like, and it is sensed the heart rate per minute of the person being monitored falls outside of a normal range, so the person being monitored may be determined to be in a dangerous situation by the information analysis module 240.

In this case, whether the person being monitored enters and exits the place may be determined through the left-right movement direction information.

When it is sensed by the action sensing module 120 that the person being monitored has not entered and exit a specific place, the heart rate information of the person being monitored may be combined with information other than the door opening/closing information and left/right movement direction information and analyzed.

Figure 10:
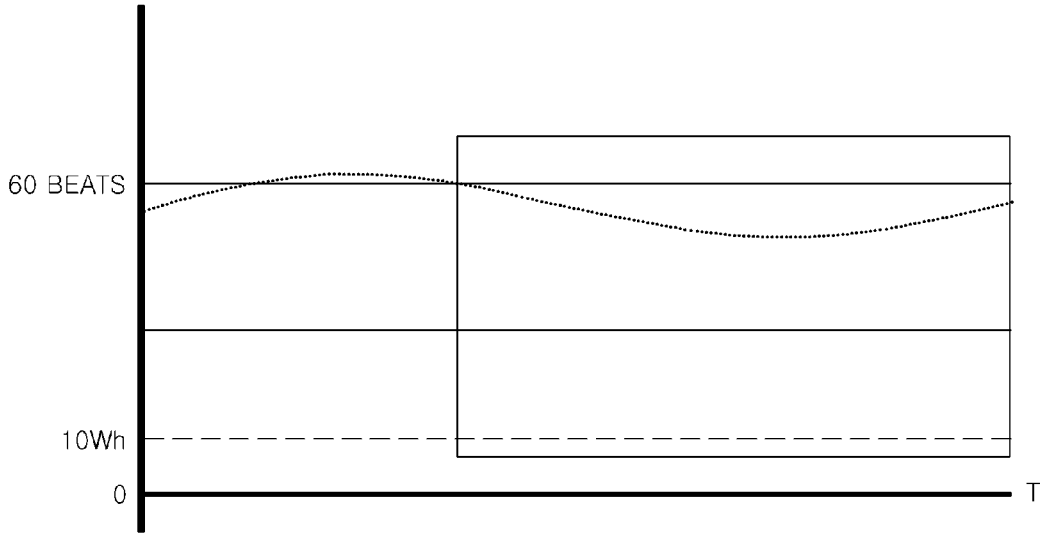
FIG. 10 is a graph illustrating information on a heart rate per minute of a person being monitored and power consumption information according to the embodiment of the present invention.

FIG. 10 is a graph illustrating information on a heart rate per minute (dotted line) of a person being monitored and power consumption information (dashed line) according to the embodiment of the present invention.

Referring to FIG. 10, information on a heart rate per minute of a person being monitored, which is regarded as abnormal for a predetermined period of time among the divided sensing information, and power consumption information are combined by the information analysis module 240.

In this case, it is sensed that the power consumption is 60 Wh or less, or does not change for a predetermined period of time, and it is sensed that the heart rate per minute of the person being monitored falls outside of a normal range, so the person being monitored may be determined to be in a dangerous situation by the information analysis module 240.

In this case, when it is sensed that the movement of the person being monitored is remarkably slow or that the person being monitored does not move for a predetermined period of time, movement speed information of the person being monitored may also be combined with the information on the heart rate per minute and the power consumption information.

Figure 11:
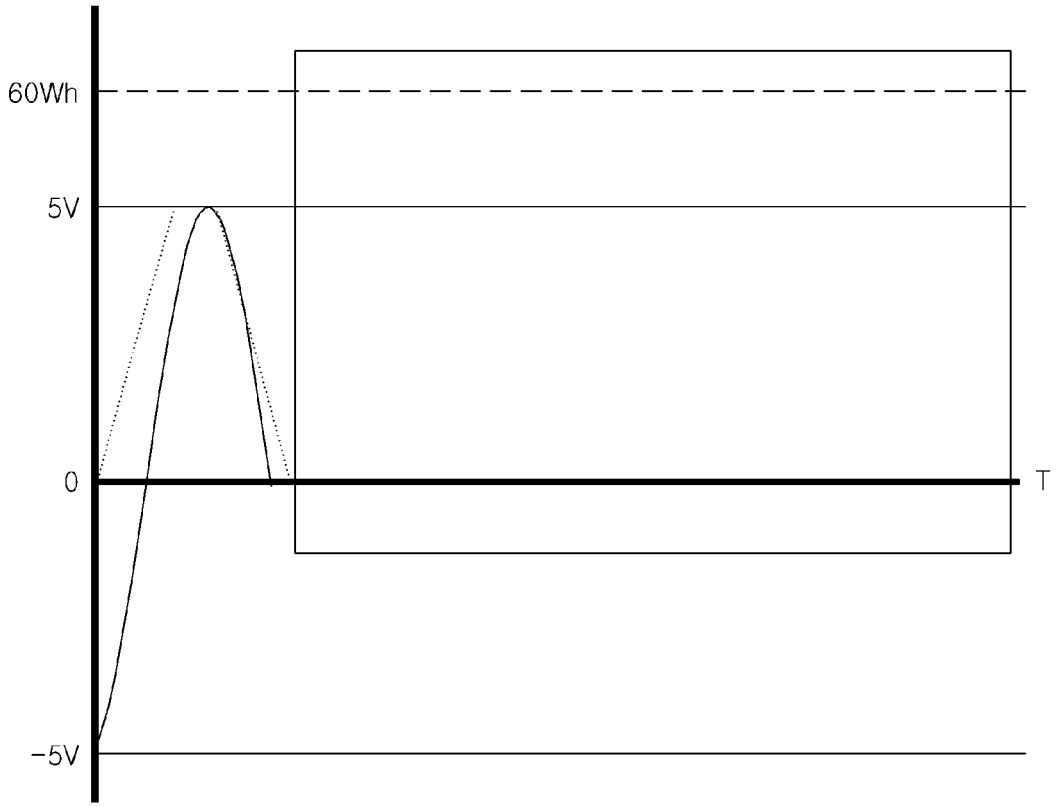
FIG. 11 is a graph illustrating door opening/closing information, power consumption information, and left-right movement direction information of a person being monitored according to the embodiment of the present invention.

FIG. 11 is a graph illustrating door opening/closing information (dotted line), power consumption information (dashed line), and left-right movement direction information (solid line) of a person being monitored according to the embodiment of the present invention.

Referring to FIG. 11, door opening/closing information and power consumption information, which are regarded as abnormal for a predetermined period of time among the divided sensing information, and left-right movement direction information of the person being monitored, among the information capable of being combined therewith, are combined by the information analysis module 240.

In this case, it is sensed that there is no change in power consumption for a predetermined period of time, and it is sensed that the door is not opened again for a predetermined period of time after the person being monitored enters and exits a specific place, so the person being monitored may be determined to be in a dangerous situation by the information analysis module 240.

As shown in FIGS. 6 to 11, the information analysis module 240 may perform analysis by combining two or more pieces of divided sensing information.

FIG. 12 is a diagram illustrating the case in which respective pieces of sensing information can be combined according to the embodiment of the present invention.

Referring to FIG. 12, heart rate information of the person being monitored may be combined with one or more pieces of information on a moving direction, speed, and body temperature of the person being monitored, door opening/closing information, and power consumption information.

In addition, the door opening/closing information may be combined with one or more of power consumption information and movement direction information.

Meanwhile, the vulnerable social group danger recognition detection method based on multiple sensing according to the embodiment of the present invention has been expressed as operations S100 to S820 in order to more easily explain the respective operations, and the sequence thereof is not limited thereto, and the respective operations may be performed in sequence or parallel.

The scope of the present invention should be construed to encompass all changes or modifications derived from the technical idea of the present invention in addition to the embodiments disclosed herein.

What is claimed is:

1. A vulnerable social group danger recognition detection method based on multiple sensing, the method comprising the operations of:

(S100) sensing biometric information, actions, and residence states of a person being monitored by a sensing means comprised of one or more sensors;

(S200) inputting sensing information in which biometric information, action information, and residence state information of the person being monitored are combined from the sensing means to an information input module;

(S300) transmitting the sensing information combined by the information input module to an information storage module and a validity determination module;

(S400) determining the validity of the sensing information by the validity determination module;

(S500) separating sensing information corresponding to invalid information among the sensing information stored in the information storage module into garbage information, and deleting the garbage information after a predetermined period of time elapses;

(S600) transmitting the sensing information corresponding to valid information in the information storage module to an information analysis module;

(S700) dividing the sensing information into biometric information, action information, and residence state information of the person being monitored, respectively, by the information analysis module using an artificial neural network, and combining abnormal information among the divided information to analyze a dangerous situation of the person being monitored; and (S800) outputting a dangerous-situation analysis result derived through the information analysis module and an alarm signal according thereto by a result output module.

2. The method of claim 1, wherein, in the operation (S400), a plurality of sensing values constituting the sensing information are individually analyzed by the validity determination module, and if any one thereof is determined to be abnormal information, sensing time information of corresponding sensing information is transmitted to the information storage module, and wherein, in the operation (S600), the sensing information corresponding to the sensing time information received from the validity determination module is transmitted to the information analysis module by the information storage module.

3. The method of claim 2, wherein, in the operation (S400), the validity of the sensing information is preferentially determined on the basis of the biometric information among the biometric information, the action information, and the residence state information of the person being monitored by the validity determination module.

4. The method of claim 1, wherein, in the operation (S200), the sensing information input from the sensing means is grouped for each predetermined time range by the information input module.

5. The method of claim 1, wherein the operation (S100) comprises the operations of:

(S110) sensing biometric information of the person being monitored through a biometric information collection module, (S120) sensing actions of the person being monitored through an action sensing module, (S130) sensing whether a door is opened or closed in a residence through a door sensing module, and (S140) sensing power consumption in the residence through a power sensing module.

* * * * *